US012168561B2

(12) United States Patent
Post et al.

(10) Patent No.: US 12,168,561 B2
(45) Date of Patent: Dec. 17, 2024

(54) PRODUCT MAILER

(71) Applicant: The Gillette Company LLC, Boston, MA (US)

(72) Inventors: Kyra Cecelia Post, Cambridge, MA (US); Marc Philip Ortins, Reading, MA (US)

(73) Assignee: The Gillette Company LLC, Boston, MA (US)

( * ) Notice: Subject to any disclaimer, the term of this patent is extended or adjusted under 35 U.S.C. 154(b) by 194 days.

(21) Appl. No.: 17/384,304

(22) Filed: Jul. 23, 2021

(65) Prior Publication Data

US 2023/0028418 A1 Jan. 26, 2023

(51) Int. Cl.

| | |
|---|---|
| ***B65D 75/36*** | (2006.01) |
| ***B65B 5/04*** | (2006.01) |
| ***B65B 5/06*** | (2006.01) |
| ***B65D 75/58*** | (2006.01) |
| ***B65D 77/04*** | (2006.01) |

(52) U.S. Cl.

CPC ..... *B65D 75/367* (2013.01); *B65B 5/04* (2013.01); *B65B 5/06* (2013.01); *B65D 75/5827* (2013.01); *B65D 77/04* (2013.01)

(58) Field of Classification Search

CPC ..... B65D 83/0463; B65D 2575/3227; B65D 75/367; B65D 2585/88; B65D 77/04; B65D 75/5827

USPC ..... 206/461–471, 15.3, 362.3

See application file for complete search history.

(56) References Cited

U.S. PATENT DOCUMENTS 3,004,661 A 10/1961 Schnmann
3,121,492 A * 2/1964 Richard ..... B65D 75/367 206/820
3,246,746 A * 4/1966 Holley ..... B65D 73/0092 428/178
3,737,029 A * 6/1973 Serrell ..... B65D 75/327 206/820
3,743,084 A 7/1973 Douglas (Continued)

FOREIGN PATENT DOCUMENTS

CN 103029143 B 1/2016
DE 8127563 U1 3/1982

(Continued)

OTHER PUBLICATIONS

All Office Actions; U.S. Appl. No. 17/384,277, filed Jul. 23, 2021.

(Continued)

*Primary Examiner* — Chun Hoi Cheung
(74) *Attorney, Agent, or Firm* — John M. Lipchitz

(57) ABSTRACT

A product mailer with an envelope and a first card positioned within the envelope. The first card has a bottom surface and a plurality of containers mounted to the bottom surface of the first card. Each of the containers mounted to the first card defines a cavity dimensioned to hold a respective product. A second card is positioned within the envelope. The second card has a bottom surface facing the bottom surface of the first card. A plurality of containers are mounted to the bottom surface of the second card. Each of the containers mounted to the second card defines a cavity dimensioned to hold a respective product. The containers mounted to the first card are offset from the containers mounted to the second card.

9 Claims, 7 Drawing Sheets

(56) References Cited

U.S. PATENT DOCUMENTS

| | | | | |
|---|---|---|---|---|
| 3,970,194 | A * | 7/1976 | Iten | B26B 21/40 206/469 |
| 3,972,417 | A | 8/1976 | Iten et al. | |
| 4,165,805 | A | 8/1979 | Fethke et al. | |
| 4,168,002 | A | 9/1979 | Crosby | |
| 4,285,428 | A | 8/1981 | Beddall et al. | |
| 4,359,158 | A | 11/1982 | Gringer | |
| D275,737 | S | 10/1984 | Iten et al. | |
| 5,279,417 | A | 1/1994 | Seaton | |
| 5,595,295 | A | 1/1997 | Lin | |
| 5,660,273 | A * | 8/1997 | Discko, Jr. | A61M 35/003 206/229 |
| D387,977 | S * | 12/1997 | Kallgren | D9/732 |
| D391,156 | S * | 2/1998 | Stevens | D9/758 |
| 5,899,333 | A * | 5/1999 | Williams | B65D 75/322 206/469 |
| 6,253,920 | B1 * | 7/2001 | Kallgren | B65D 75/527 206/532 |
| 6,439,390 | B1 * | 8/2002 | Kumakura | B65D 75/367 206/469 |
| 7,344,026 | B2 | 3/2008 | Melgaard | |
| 7,780,009 | B2 * | 8/2010 | Casanova | B65B 11/50 206/705 |
| D649,886 | S | 12/2011 | Ocampo | |
| 8,083,058 | B2 | 12/2011 | Marcinkowski et al. | |
| 8,443,977 | B2 * | 5/2013 | Killinger | B65D 83/0463 206/532 |
| 8,757,370 | B2 | 6/2014 | Krok | |
| 9,296,536 | B2 * | 3/2016 | Haering | B65B 5/02 |
| 9,592,179 | B2 * | 3/2017 | Wagner | B65D 83/0463 |
| 10,123,606 | B1 | 11/2018 | Krok et al. | |
| 10,899,029 | B1 | 1/2021 | Atlason | |
| 2005/0051459 | A1 * | 3/2005 | Casanova | B65D 75/367 206/703 |
| 2005/0191544 | A1 | 9/2005 | Casanova | |
| 2009/0172958 | A1 | 7/2009 | Prudden et al. | |
| 2013/0056386 | A1 * | 3/2013 | Wagner | B65D 81/05 53/457 |
| 2013/0105351 | A1 | 5/2013 | Smart | |
| 2015/0344207 | A1 | 12/2015 | Zacherle | |
| 2016/0194130 | A1 | 7/2016 | Zacherle | |

FOREIGN PATENT DOCUMENTS

| | | | |
|---|---|---|---|
| EP | 0000178 | A1 | 1/1979 |
| EP | 2547308 | B1 | 8/2014 |
| GB | 2043020 | A | 10/1980 |
| JP | S4885894 | U | 10/1973 |
| WO | 0109001 | A1 | 2/2001 |
| WO | 2005073105 | A2 | 8/2005 |

OTHER PUBLICATIONS

All Office Actions; U.S. Appl. No. 29/810,169, filed Oct. 1, 2021.

U.S. Appl. No. 17/384,277, filed Jul. 23, 2021, to Kyra Cecelia Post et al.

PCT Search Report and Written Opinion for PCT/US2022/073619 dated Nov. 2, 2022, 16 pages.

* cited by examiner

PRODUCT MAILER

FIELD OF THE INVENTION

The present invention relates generally to packages for consumer products and more particularly, to direct to consumer packages that may be shipped through standard mail systems.

BACKGROUND OF THE INVENTION

More consumers are starting to prefer shopping online and receiving product in the mail rather than going to stores to make purchases in person. Accordingly, manufactures have been providing direct to consumer (DTC) packages to ship their products safely and economically to consumers. Another consumer trend is sustainability. Consumers prefer products and packages that are more sustainable, have less waste and a smaller environmental impact. The cost of shipping products through the mail system is typically absorbed by the manufacturer. Accordingly, manufacturers need to minimize costs as much as possible to maintain margins that are similar to selling the same product in a store. It typically costs more to ship products in boxes than envelopes. However, shipping products in envelopes requires the product being shipped must be below a certain thickness and meet flexibility requirements. For example, the United States Postal Office requires that when a product is placed in the standard shipping envelope, the envelope must be flexible along the two axes of the envelope in order for the envelope to be successfully processed by the current sorting equipment. It is also preferred to send more products within an envelope to decrease overall shipping costs. However, shifting of the products within the envelope may negatively impact the flexibility of the envelope depending on the location of the products within the envelope.

More packages are being designed for direct to consumer product offerings. However, consumers desire the same ease of use and functionality of products and packages that are sold in stores. Despite the use of known packaging techniques, there remains a need to further modify consumer product packages to provide a package that allows manufacturers to ship products to consumers in a reliable, economically and efficient manner without negatively impacting the consumer experience.

SUMMARY OF THE INVENTION

In one aspect, the invention features, in general, a product mailer with an envelope and a first card positioned within the envelope. The first card has a bottom surface and a plurality of containers mounted to the bottom surface of the first card. Each of the containers mounted to the first card defines a cavity dimensioned to hold a respective product. A second card is positioned within the envelope. The second card has a bottom surface facing the bottom surface of the first card. A plurality of containers are mounted to the bottom surface of the second card. Each of the containers mounted to the second card defines a cavity dimensioned to hold a respective product. The containers mounted to the first card are offset from the containers mounted to the second card.

In another aspect, the invention features, in general, a product mailer having an envelope. A first card is positioned within the envelope. The first card has four quadrants, a top surface and a bottom surface. A container extends from each of the four quadrants of the bottom surface of the first card. A second card is positioned within the envelope. The second card has four quadrants, a top surface and a bottom surface facing the bottom surface of the first card. A container extends from each of the four quadrants of the bottom surface of the second card. At least two of the containers of the second card are positioned between at least two of the containers of the first card.

In another aspect, the invention features, in general, a method of assembling a product mailer by sealing a plurality of containers to a bottom surface of a first card. A plurality of containers are sealed to a bottom surface of a second card. A product is positioned within a cavity defined by each of the containers sealed to the first card. A product is positioned within a cavity defined by each of the containers sealed to the second card. The first card is positioned over the second card. The bottom surface of the first card contacts one or more of the containers sealed to the second card.

DETAILED DESCRIPTION OF THE INVENTION

Figure 1:
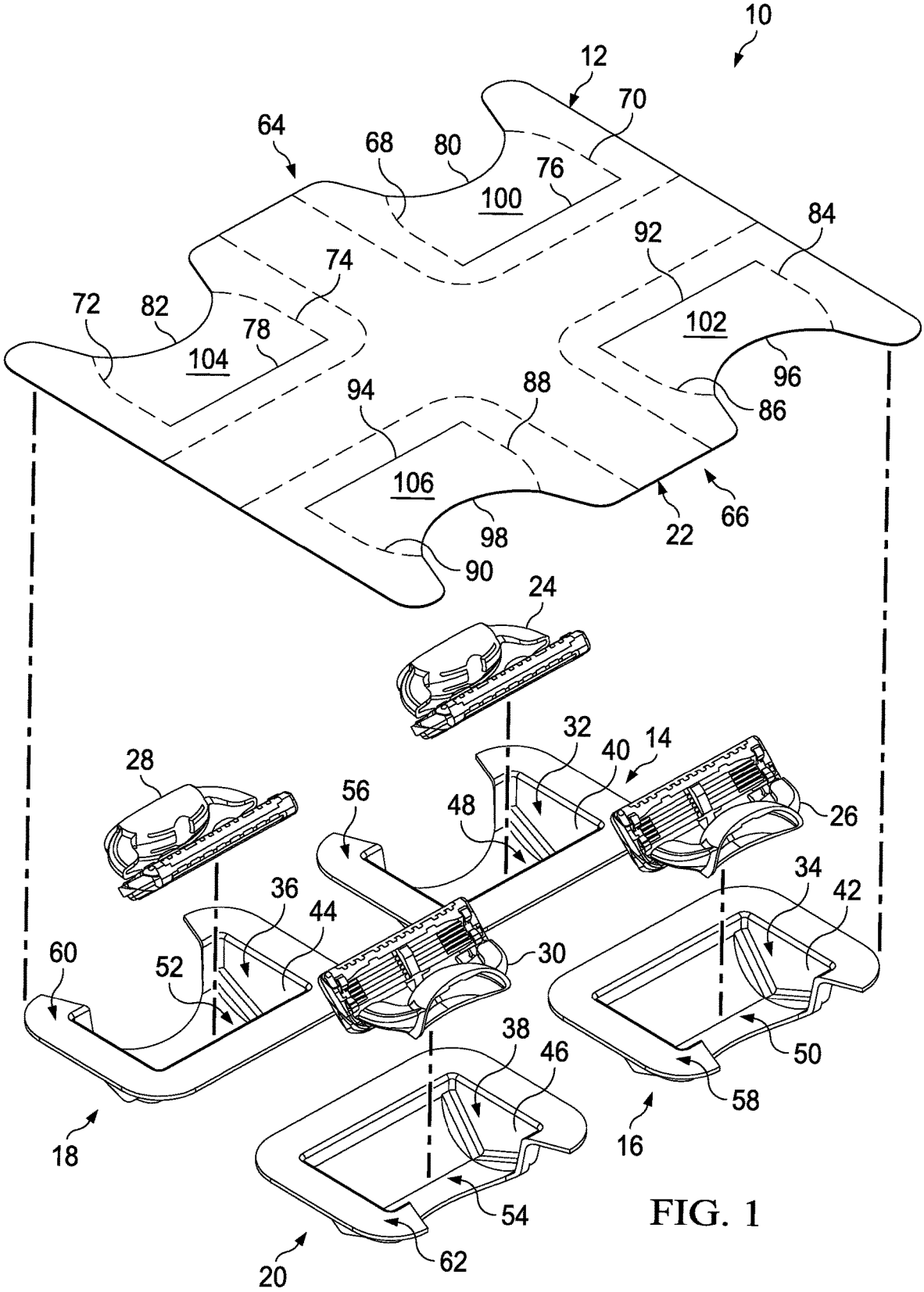
FIG. 1 is an assembly view of one possible embodiment of a package.

Referring to FIG. 1, an assembly view of one possible embodiment of a package 10 is shown. The package 10 may include a card 12 (e.g., a first card) and one or more containers 14, 16, 18 and 20 mounted to a bottom surface 22 of the card 12. The card 12 and/or the containers 14, 16, 18, and 20 may comprise one or more plant based materials, such as paperboard or bamboo. One or more products 24, 26, 28 and 30 may be positioned within a storage region 32, 34, 36 and 38 of the respective containers 14, 16, 18 and 20. Although the products 24, 26, 28 and 30 illustrated in FIG. 1 are cartridges for (e.g., for shaving), it is understood that other consumer products may be used, such as tooth brushes. Each of the storage regions 32, 34, 36 and 38 may be defined by respective side walls 40, 42, 44 and 46 extending upward from a lower region 48, 50, 52 and 54 to a top surface, such as a flange 56, 58, 60 and 62. The card 12 may be mounted to the flanges 56, 58, 60 and 62. In certain embodiments, the plurality of the containers 14, 16, 18 and 20 may be mounted and/or secured to the bottom surface 22, for example, with adhesive or other conventional methods known to those skilled in the art.

The card 12 may have a leading edge 64 and an opposing trailing edge 66. The leading edge 64 may be opposite and parallel to the trailing edge 66. The card 12 may have a first pair of perforated segments 68 and 70 and a second pair of perforated segments 72 and 74 extending inward from the leading edge 64. In certain embodiments, the first pair of perforated segments 68 and 70 and the second pair of perforated segments 72 and 74 may extend to a respective crease line 76 and 78. The leading edge 64 may have one or more curved regions 80 and 82 associated with the containers 14 and 18, respectively. The perforated segments 68 and 70 may extend from the curved region 80 and the perforated segments 72 and 74 extend from the curved region 82. In certain embodiments, the first pair of perforated line segments 68 and 70 may extend from the curved region 80 to the crease line 76. Similarly, the second pair of perforated line segments 72 and 74 (associated with the container 18) may extend from the curved region 82 to the crease line 78. In certain embodiments, the crease lines 76 and 78 may extend in a direction generally parallel to the leading edge 64 and/or the curved regions 80 and 82.

The card 12 may have a first pair of perforated segments 84 and 86 and a second pair of perforated segments 88 and 90 extending inward from the trailing edge 66. In certain embodiments, the first pair of perforated segments 84 and 86 and the second pair of perforated segments 88 and 90 may extend to a respective crease line 92 and 94. The trailing edge 66 may have one or more curved regions 96 and 98 from which the respective perforated segments 84, 86, 88 and 90 extend. For example, the first pair of perforated line segments 84 and 86 may extend from the curved region 96 to the crease line 92. Similarly, the second pair of perforated line segments 88 and 90 may extend from the curved region 98 to the crease line 84. In certain embodiments, the crease lines 92 and 94 may extend in a direction generally parallel to the trailing edge 66 and/or the curved regions 96 and 98.

The card 12 may have one or more perforated tabs 100, 102, 104 and 106 associated with one of the containers 14, 16, 18 and 20 to facilitate removal of the respective products 24, 26, 28 and 30 from the package 10. For example, the tearing of the perforated line segments 68 and 70 by lifting the perforated tab 100 (e.g., first perforated tab) may facilitate access and removal of the product 24 from the package 10. The first perforated tab 100 may be defined by the crease line 76 and the perforated line segments 68 and 70. The crease line 76 may facilitate keeping the perforated tab 100 in an open position, thus providing improved access and removal of the product 24. The curved region 80 may provide more intuitive identification and lifting of the tab 100.

The container 16 (e.g., second container) may be aligned with perforated tab 102 (e.g., second perforated tab). Accordingly, the tearing of the perforated line segments 84 and 86 by lifting the perforated tab 102 may facilitate access and removal of the product 26 from the package 10. The perforated tab 102 may be defined by the crease line 92 and the perforated line segments 84 and 86. The crease line 92 may facilitate keeping the perforated tab 102 in an open position, thus providing improved access and removal of the product 26. The curved region 96 may provide for more intuitive identification and lifting of tab 102.

The container 18 (e.g., third container) may be aligned with perforated tab 104 (e.g., third perforated tab). Accordingly, the tearing of the perforated line segments 72 and 74 by lifting the perforated tab 104 may facilitate access and removal of the product 28 from the package 10. The perforated tab 104 may be defined by the crease line 78 and the perforated line segments 72 and 74. The crease line 78 may facilitate keeping the perforated tab 104 in an open position, thus providing improved access and removal of the product 28. The curved region 82 may more intuitive identification and lifting of the tab 104.

The container 20 (e.g., fourth container) may be with the perforated tab 106 (e.g., fourth perforated tab). Accordingly, the tearing of the perforated line segments 88 and 90 by lifting the perforated tab 106 may facilitate access and removal of the product 30 from the package 10. The perforated tab 106 may be defined by the crease line 94 and the perforated line segments 88 and 90. The crease line 94 may facilitate keeping the perforated tab 106 in an open position, thus providing improved access and removal of the product 30. The curved region 98 may more intuitive identification and lifting of tab 106.

Figure 2A:
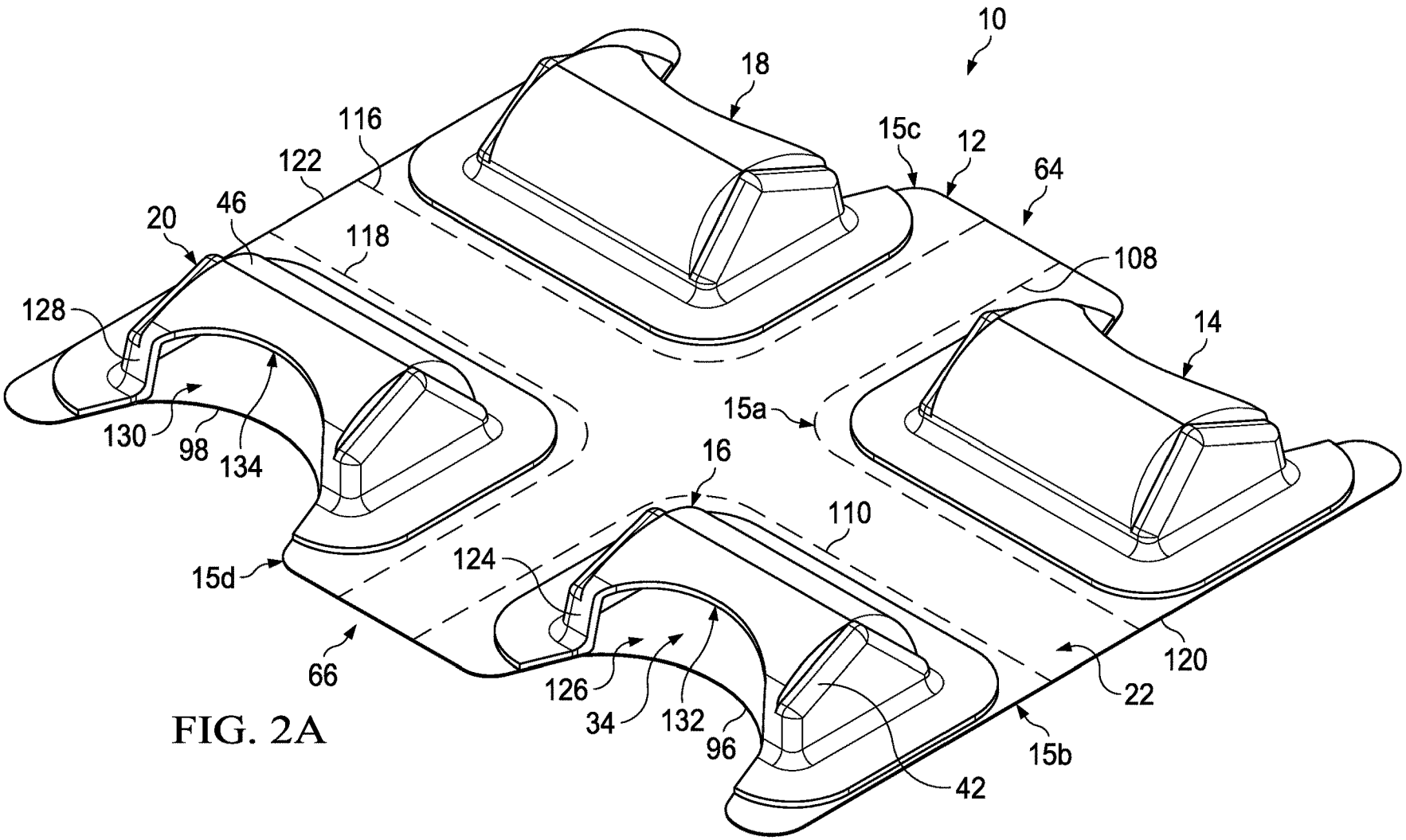
FIG. 2A is a front, bottom perspective view of the package of FIG. 1.
Figure 2B:
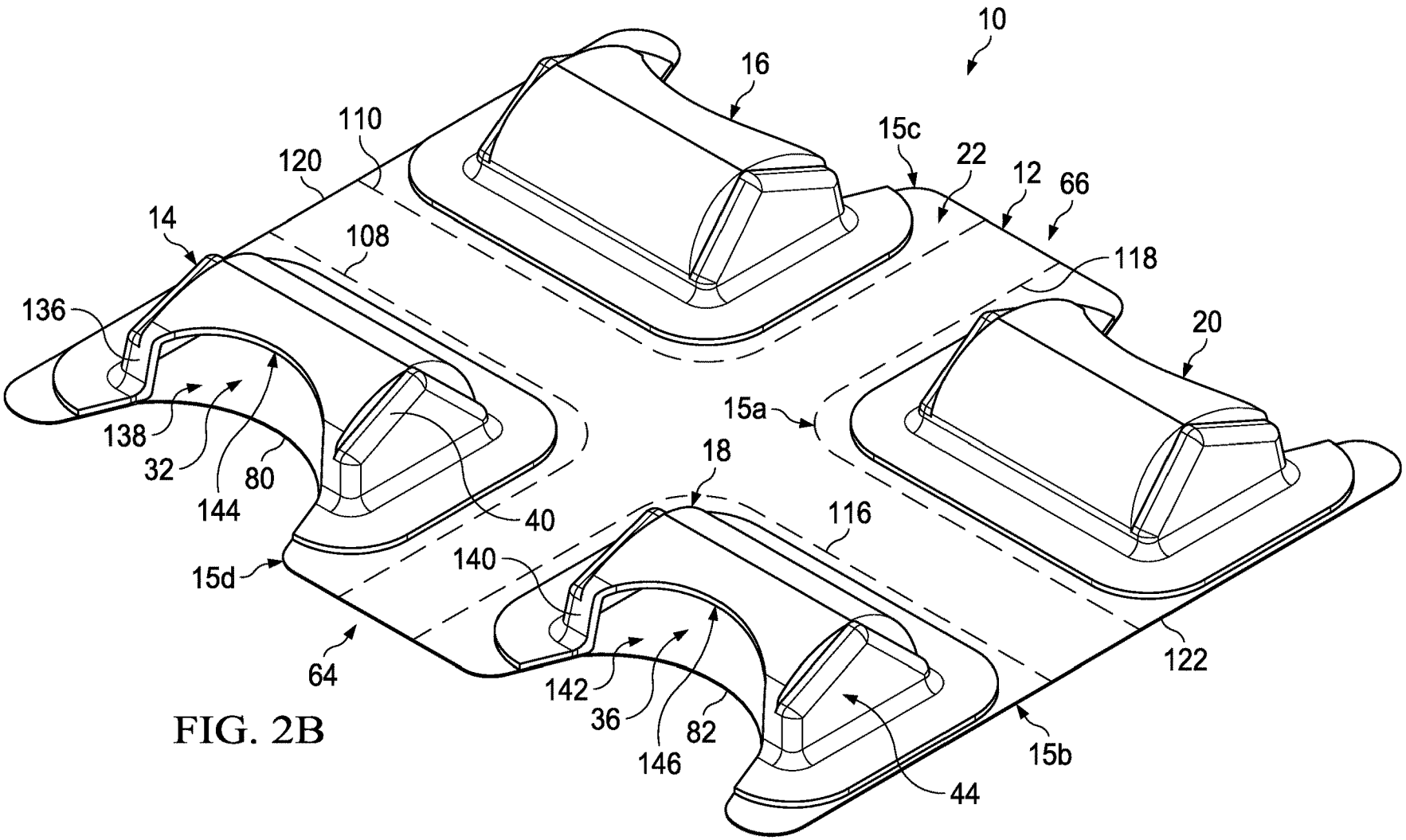
FIG. 2B is a rear, bottom perspective view of the package of FIG. 1.

Referring to FIGS. 2A and 2B, a bottom perspective views of the package 10 is illustrated. In certain embodiments, the card 12 may include four quadrants 15*a*, 15*b*, 15*c* and 15*d*. One of the containers 14, 16, 18, and 20 may be positioned in each of the quadrants 15*a*, 15*b*, 15*c* and 15*d*. The containers 14, 16, 18 and 20 may extend from the bottom surface 22 of the card 12. The card 12 may have a slit line 108, 110, 112, and 114 extending around the respective containers 14, 16, 18 and 20 to facilitate the separation of the various containers 14, 16, 18 and 20. The slit line 108 may extend from the leading edge 64 to a first outer edge 120 transverse to the leading edge 64. The slit line 110 may extend from the trailing edge 66 to the first outer edge 120. The slit line 116 may extend from the leading edge 64 to a second outer edge 122. The first outer edge 120 may be parallel to the second outer edge 122. The slit line 118 may extend from the second outer edge 122 to the trailing edge 66. The slit lines 108, 110, 112, and 114 may divide the card into the respective quadrants 15*a*, 15*b*, 15*c* and 15*d*.

As shown in FIG. 2A, the side walls 42 of the container 16 may include a front face 124 that defines an opening 126 extending into the storage region 34. The side walls 46 of the container 20 may include a front face 128 that defines an opening 130 extending into the storage region 34. The openings 126 and 130 may face in the same direction and may be defined by a portion of the trailing edge 66 (e.g., the curved regions 96 and 98). The front faces 124 and 128 may have a respective arcuate edge 132 and 134 to allow for improved access and removal of the products 26 and 30 from the containers 16 and 20. The openings 126 and 130 may extend in a direction generally parallel to the card 12. The openings 126 and 130 may face in the same direction (e.g., same direction as the trailing edge 66). The openings 126 and 130 facing outward and at the trailing edge 66 may facilitate the insertion of a handle (not shown) into the openings 126 and 130 because the openings 126 and 130 are not obstructed by another structure.

As shown in FIG. 2B, the side walls 40 of the container 14 may include a front face 136 that defines an opening 138 extending into the storage region 32. The side walls 44 of the container 18 may include a front face 140 that defines an opening 142 extending into the storage region 36. The openings 138 and 142 may extend in a direction generally parallel to the card 12. The openings 138 and 142 may face in the same direction (e.g., same direction as the leading edge 64). The openings 138 and 142 facing outward and positioned at the leading edge 64 may facilitate the insertion of a handle (not shown) into the openings 138 142 because the openings 138 and 142 are not obstructed by another structure. Accordingly, the openings 138 and 142 may face in an opposite direction of the openings 126 and 130 (FIG. 2A). The openings 138 and 142 may be defined by a portion of the leading edge 64 (e.g., the curved regions 80 and 82). The front faces 136 and 140 may have a respective arcuate edge 144 and 146 to allow for improved access and removal of the products 24 and 28 from the containers 14 and 18. The openings 138 and 142 may extend in a direction generally parallel to the card 12 (e.g., not into or through the card 12).

Although the card 12 illustrated in FIGS. 2A and 2B is rectangular shaped, it is understood the card 12 may have other geometries to facilitate the positioning of the openings 126, 130, 138 and 142 all facing in an outer direction to facilitate insertion of a handle (not shown). For example, the card 12 may have a circular shape with openings facing outward.

Figure 3:
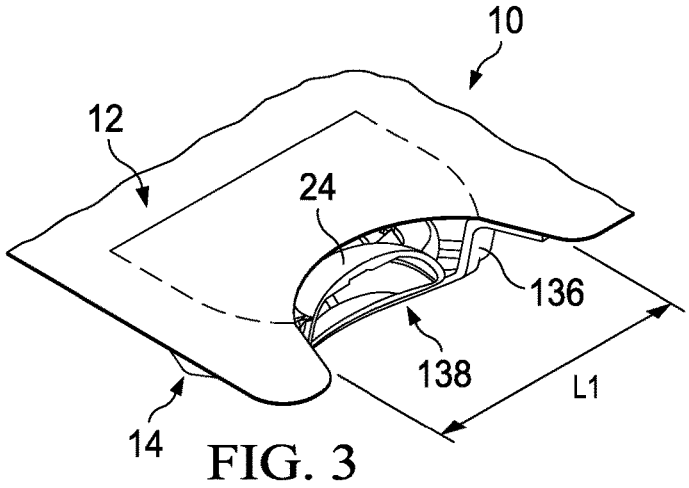
FIG. 3 is a top perspective view of a portion of the package of FIG. 1.
Figure 4:
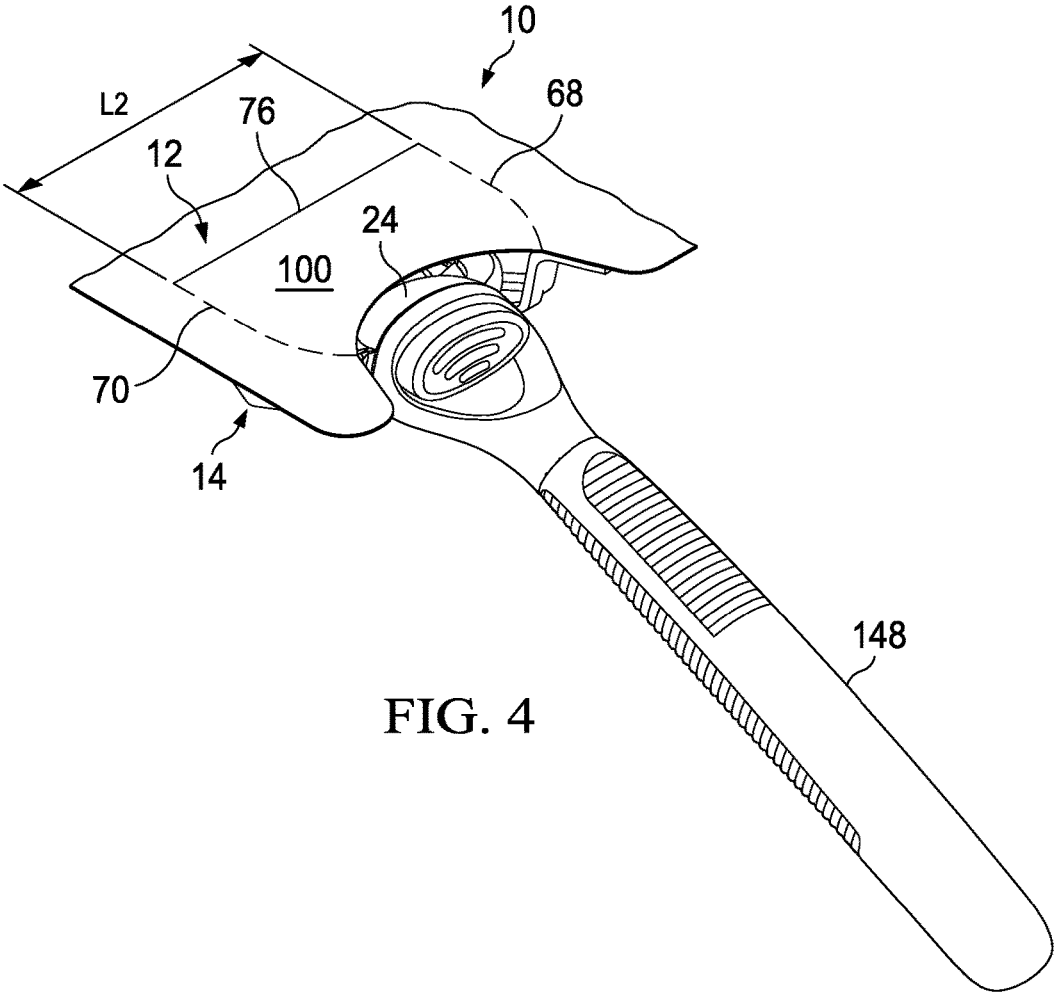
FIG. 4 is a top perspective view of a handle being inserted in the package of FIG. 3.
Figure 5:
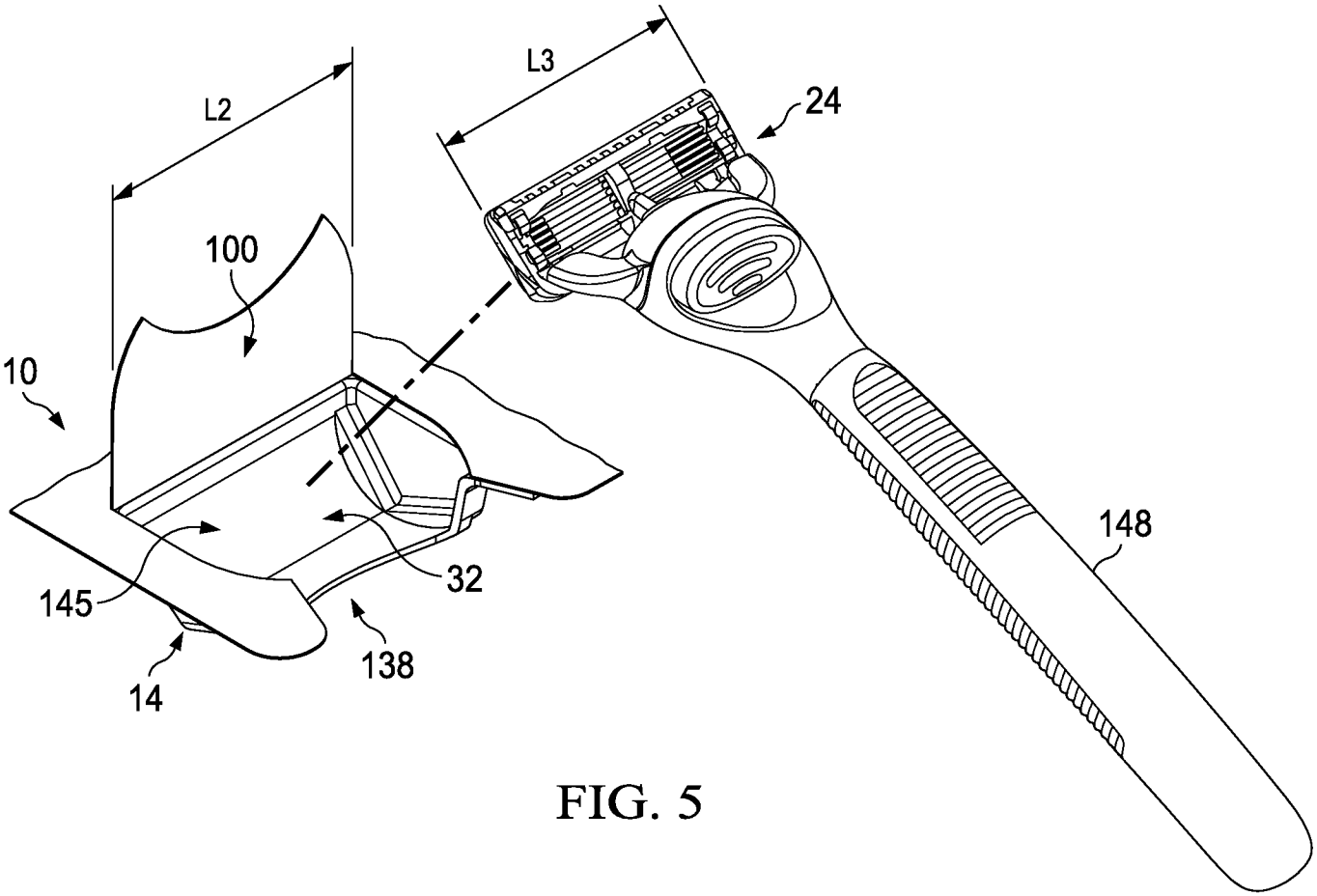
FIG. 5 is a top perspective view of the handle removing a product from the container of FIG. 3.

FIGS. 3-5 illustrate the removal of one of the products 24, 26, 28 and 30 from the respective containers 14, 16, 18 and 20 shown in FIG. 1. It is understood that the package 10, may include the card 12 with multiple containers 14, 16, 18 and 20 (as shown in FIG. 1) or the card 12 having a portion removed with a single container (as shown in FIGS. 3-5). For example, the package 10 shown in FIGS. 3-5 may represent a portion the card 12 having been separated along the slit line 108 (FIG. 2A). The opening 138 defined by the front face 136 may have a length "L1" that prevents the product 24 from inadvertently falling out of the container 14. However, the opening 138 may be dimensioned to receive a handle 148 (FIG. 4). The handle 148 may be able to connect to the product 24 through the opening 138. The handle 148 may extend generally parallel to the card 12 during insertion. The perforated segments 68 and 70 may facilitate separating the tab 100 from a portion of the card 12. For example, the tab 100 may be pealed back towards the crease line 76, tearing the card 12 along the perforated segments 68 and 70, as shown in FIG. 5. A length "L2" between the pair of perforated line segments 68 and 70 may define a cartridge opening 145 that may be greater than or equal to a length "L3" of the product 24, thus allowing the product 25 to be removed from the storage region 32 of the container 14 (e.g., via the cartridge opening 145 created by the lifting of the tab 100). Accordingly, the product 24 cannot be removed through the opening 138, but may be removed through the cartridge opening 145 created by the tab 100.

Figure 6:
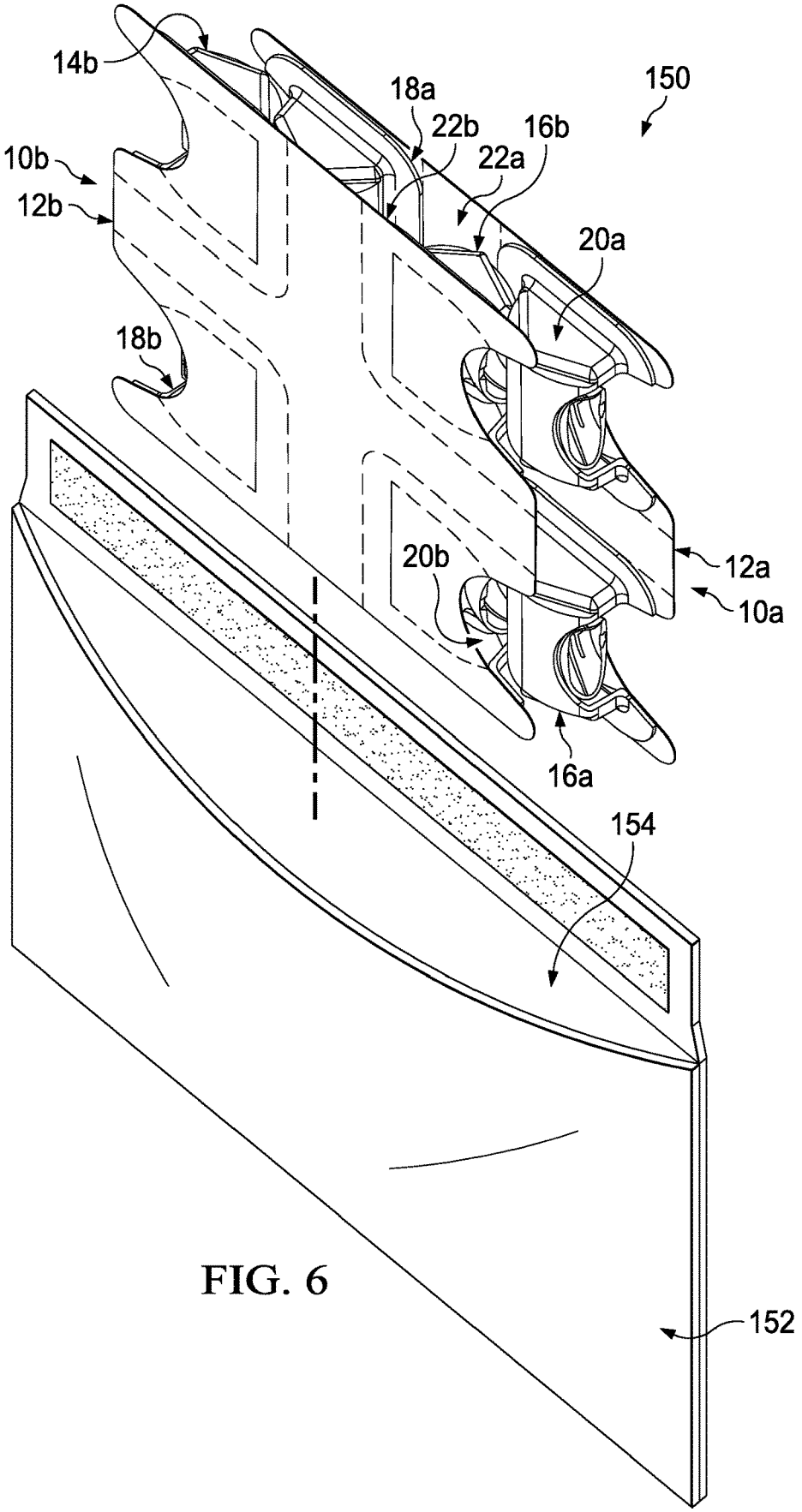
FIG. 6 is an assembly view of a product mailer.

Referring to FIG. 6, one possible embodiment of the present invention is shown illustrating an assembly view of a product mailer 150. The product mailer 150 may include a shipping envelope 152 defining a pocket 154 configured to receive one or more of the packages 10 (e.g., a first package 10*a* and a second package 10*b*), as previously described. For example, FIG. 6 illustrates two of the packages 10*a* and 10*b* placed in the envelope 152; however it is understood only one of the packages 10*a* and 10*b* may be placed in the envelope 152 or more packages 10*a* and 10*b* may be placed within a larger envelope. It is understood that the first and second packages 10*a* and 10*b* are structurally the same as the package 10 previously described, accordingly, the same numerical numbers will be used to describe the first and second packages 10 and 10*b*. The first package 10*a* may include a first card 12*a* and the second package 10*b* may include a second card 12*b*. The first card 12*a* may have a bottom surface 22*a*. A plurality of containers 14*a* (hidden from view), 16*a*, 18*a* and 20*a* may extend from the bottom surface 22*a* of the first card 12*a*. The second card 12*b* may have a similar configuration as the first card 12*a*. For example, the second card 12*b* may have a bottom surface 22*b*. The bottom surface 22*b* of the second card 12*b* may face the bottom surface 22*a* of the first card 12*a*. A plurality of containers 14*b*, 16*b*, 18*b* and 20*b* may extend from the bottom surface 22*b* of the second card 12*b*.

The containers 18*a* and 20*a* of the first card 12*a* may be offset from the containers 14*b* and 16*b* of the second card 12*b* to facilitate compact stacking of the packages 12*a* and 12*b*. In certain embodiments, one or more of the containers 14*b* and 16*b* of the second card 12*b* may contact the bottom surface 22*a* of the first card 10*a*. In a similar fashion, one or more of the containers 18*a* and 20*a* of the first card 12*a* may contact the bottom surface 22*b* of the second card 12*b*. The offset configuration of the containers 14*b* and 16*b* of the second card 10*b* with the containers 18*a* and 20*a* of the first card 10*a* may provide for efficient usage of space within the pocket 154 of the envelope 152, as well as allow the envelope 152 sufficient flexibility during processing by equipment used for sorting envelopes and packages.

Figure 7:
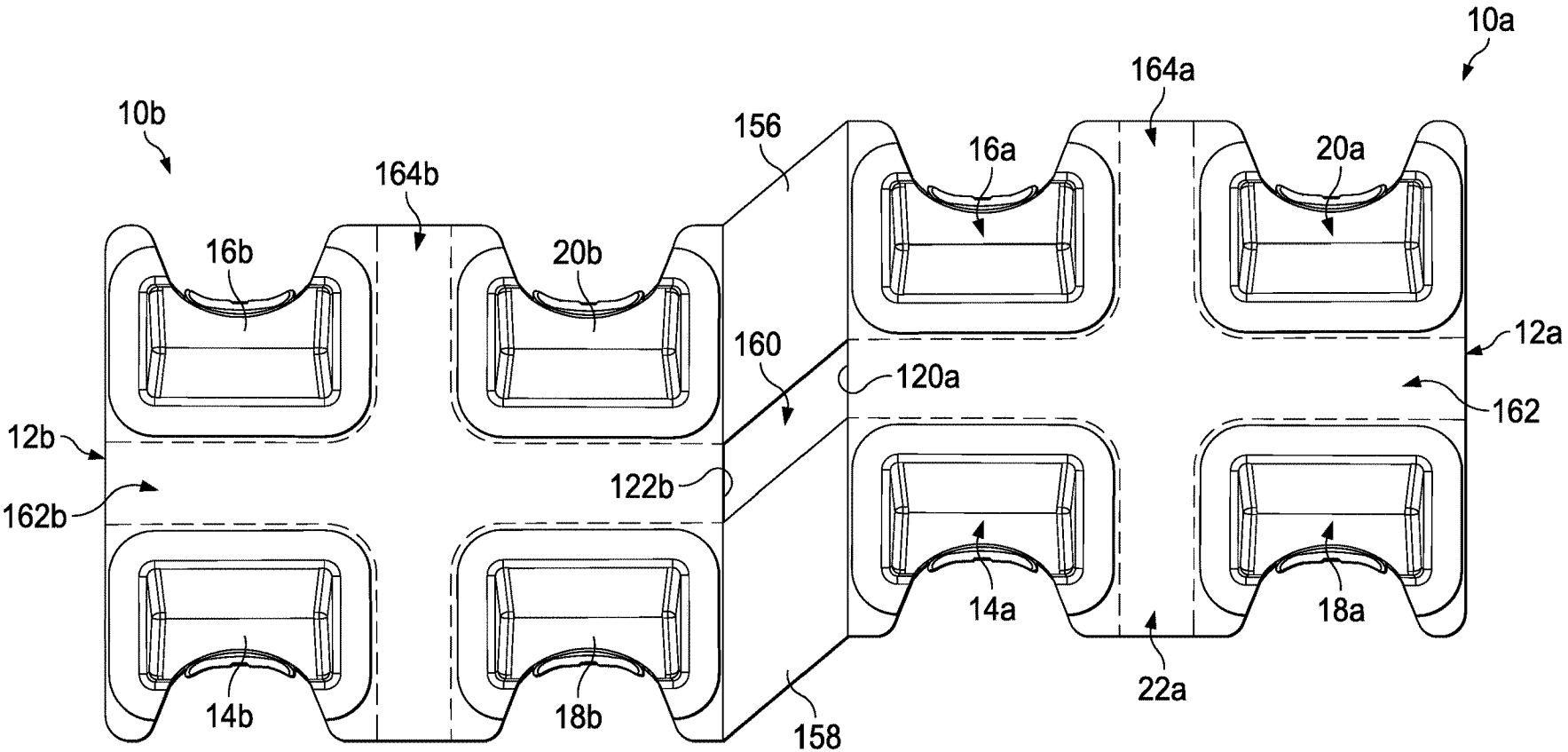
FIG. 7 is a bottom view of two of the packages of FIG. 2A connected.

Referring to FIG. 7, a bottom view of the first card 12*a* and the second card 12*b* is illustrated. In certain embodiments, the first card 12*a* may be interconnected to the second card 12*b* by one or more bridges 156 and 158. The bridges 156 and 158 may extend from the first outer edge 120*a* of the first card 12*a* to the second outer edge 122*b* of the second card 12*b*. The bridges 156 and 158 may be formed as part of the first card 12*a* and the second card 12*b* as a unitary member. The bridges 156 and 158 spaced apart by a gap 160 to provide sufficient flexibility to facilitate the first card 12*a* and the second card 12*b* to fold over each other, thus allowing the first card 12*a* and the second card 12*b* to fit within the envelope 152, as shown in FIG. 6. The containers 14*a* and 16*a* may be spaced apart and the containers 18*a* and 20*b* may be spaced apart to define a gap 162*a* extending along the bottom surface 22*a*. The gap 162*a* may be dimensioned to receive two containers 16*b* and 20*b* of the second card 12*b* (e.g., the containers 16*b* and 20*b* may be positioned on gap 162*a* of the bottom surface 22*a* of the first card 12*a* when the second card 12*b* is folded on top of the first card 12*a*. Similarly, the second card 12*b* may have a gap 162*b* defined by the spacing apart of the containers 14*b* from 16*b* and 18*b* from 20*b*. The containers 14*a*, 16*a*, 18*a* and 20*a* of the first card 12*a* may be spaced apart to define a second gap 164*a* that extends in a transverse direction to the gap 162*a*. Similarly, the containers 14*a*, 16*a*, 18*a* and 20*a* of the second card 12*b* may be spaced apart to define a second gap 164*b* that extends in a transverse direction to the gap 162*a*. The gaps 162*a*, 162*b*, 164*a* and 164*b* may provide flexibility along two axis of the first and second packages 10*a* and 10*b*, thus facilitating proper handling and sorting by a shipping company (e.g., United States Post Office) when they are inserted into the envelope 152.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm" Furthermore, dimensions should not be held to an impossibly high standard of metaphysical identity that does not allow for discrepancies due to typical manufacturing tolerances. Therefore, the term "about" should be interpreted as being within typical manufacturing tolerances.

Every document cited herein, including any cross referenced or related patent or application is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A product mailer comprising:

an envelope;

a first card positioned within the envelope, the first card having a bottom surface;

a plurality of containers mounted to the bottom surface of the first card, each of the containers mounted to the first card defines a storage region dimensioned to hold a respective product, wherein one or more side walls of the container define a plurality of openings, each of the openings extending into one of the storage regions is not obstructed by another structure;

a second card positioned within the envelope, the second card having a bottom surface facing the bottom surface of the first card;

a plurality of containers mounted to the bottom surface of the second card, each of the containers mounted to the second card defines a storage region dimensioned to hold a respective product, wherein the containers mounted to the first card are offset from the containers mounted to the second card.

2. The product mailer of claim 1 wherein the openings are transverse to the first card.

3. The product mailer of claim 2 wherein the containers mounted to the second card each has a respective a front face defining an opening transverse to the second card.

4. The product mailer of claim 1 wherein the top surface of the first card defines a perforated tab aligned with each of the containers mounted to the first card.

5. The product mailer of claim 4 wherein the top surface of the second card defines a perforated tab aligned with each of the containers mounted to the second card.

6. The product mailer of claim 5 wherein the perforated tabs of the second card comprises a respective crease line.

7. The product mailer of claim 4 wherein the perforated tab comprises a respective crease line.

8. The product mailer of claim 1 wherein at least one of the containers mounted to the first card is in contact with the bottom surface of the second card.

9. The product mailer of claim 1 wherein the top surface of the first card comprises a plurality of perforations between the plurality of containers mounted to the first card.

* * * * *